US006227982B1

(12) United States Patent
Wurster

(10) Patent No.: US 6,227,982 B1
(45) Date of Patent: May 8, 2001

(54) DUAL ENDED LASER SWING AID

(75) Inventor: Robert L. Wurster, Burbank, CA (US)

(73) Assignee: Lazereyes Golf, LLC, Denver, CO (US)

( * ) Notice: Subject to any disclaimer, the term of this patent is extended or adjusted under 35 U.S.C. 154(b) by 0 days.

(21) Appl. No.: 09/033,438

(22) Filed: Mar. 2, 1998

Related U.S. Application Data

(60) Provisional application No. 60/038,564, filed on Mar. 3, 1997.

(51) Int. Cl.[7] ..... A63B 57/00
(52) U.S. Cl. ..... 473/220
(58) Field of Search ..... 473/220

(56) References Cited

U.S. PATENT DOCUMENTS

| | | | | |
|---|---|---|---|---|
| 2,080,608 | * | 5/1937 | Hannaford | 473/220 |
| 3,384,741 | * | 5/1968 | Bice | 473/220 X |
| 4,456,257 | * | 6/1984 | Perkins | 473/220 |
| 4,911,450 | | 3/1990 | Rabold | 273/186 A |
| 5,082,282 | * | 1/1992 | Hernberg | 473/220 |
| 5,154,427 | * | 10/1992 | Harlan | 473/220 X |
| 5,269,528 | * | 12/1993 | McCardle | 473/220 X |
| 5,464,221 | * | 11/1995 | Carney | 473/220 |
| 5,470,072 | | 11/1995 | Cunningham | 273/186.3 |
| 5,593,354 | * | 1/1997 | Falossi et al. | 473/220 |
| 5,665,006 | * | 9/1997 | Pellegrini | 473/220 |
| 5,848,941 | * | 12/1998 | Morra | 473/220 |

* cited by examiner

*Primary Examiner*—Mark S. Graham
*Assistant Examiner*—Raeann Gorden
(74) *Attorney, Agent, or Firm*—Lyon & Lyon LLP

(57) ABSTRACT

The Dual Ended Laser Swing Aid has the general shape of a golf club and consists of a grip, shaft and head. Two back-to-back axial laser modules pointing in linearly opposite directions emit an upward grip laser beam through a hole in the grip, and a downward head laser beam through a hole in the head. Both laser modules are powered by a 3 volt DC power supply located inside the grip end of the hollow shaft. This arrangement permits convenient DC battery replacement by unscrewing a grip knob at the grip end of the Dual Ended Laser Swing Aid.

During a swing with the swing aid the golfer can observe the laser traces of the grip and head lasers in a systematic manner for golf swing improvement. The laser traces can also be recorded by a video camera to allow the golfer to analyse every facet of the swing.

7 Claims, 5 Drawing Sheets

DUAL ENDED LASER SWING AID

CROSS-REFERENCES

This application is based on the invention disclosed in my Provisional Patent Application Ser. No. 60/038,564 filed on Mar. 3, 1997.

BACKGROUND OF THE INVENTION

1. Field of the Invention

This invention relates to training devices which assist a golfer to correctly swing a golf club. More particularly, it relates to training devices equipped with lasers to provide an optical indication of the complete swinging action of a golf club, including take away, back swing and down swing.

2. Background of the Invention

Training tools designed to aid golfers in producing correct club motions have included arm braces, gloves, tubular tracks, and other devices. More recently, optical devices using lasers have been proposed. A search of the U.S. patent literature revealed laser assisted golf training tools, but only for putting strokes and not golf club swings.

These patents include U.S. Pat. No. 5,217,228 to De Aguilar which shows a laser-generated light beam traveling downward inside the golf club grip until it strikes an adjustable mirror which diverts the beam to exit through a hole in the club, in a path parallel to the theoretical path of a struck golf ball. The U.S. Pat. No. 5,435,562 to Stock et al is similar, using a reflecting prism in the club hosel to emit a laser beam perpendicular to the shaft of the club. This indicates the alignment of the club face.

Another approach is taken in U.S. Pat. No. 5,452,897 to Mick in which the laser beam originates from behind the cup on a green and is directed toward the club face to determine the amount of deviation in a golfer's sighting position.

U.S. Pat. No. 5,494,290 to Stefanoski shows a laser putter in which an internal laser beam is reflected by a convex mirror onto the ground forward of the putter head to provide a line of sight which aids in lining up a putt.

These patents show training devices applicable only to putting, and moreover, lack means to determine the attitude of both ends of a golf club. It is the principal aim of the present invention to indicate the path and final position of both the grip end and the head end of a golf club during a swing. This permits complete documentation, analysis and remediation of a golf club swing.

OBJECTS OF THE INVENTION

It is an object of this invention to provide a training device which assists a golfer in correcting his or her golf swing.

It is another object to provide a training device which tracks the complete golf swing consisting of take away, back swing and down swing.

It is a further object to provide a training device which gives a continuous indication of the location and attitude of the grip and the head of a golf club during a complete golf swing.

It is still another object to provide a training device which is self-acting, portable and suitable for golfers of all sizes and both genders.

It is yet another object to provide a training device which is rugged, inexpensive, and simple to use indoors or outdoors.

SUMMARY OF THE INVENTION

To implement the stated objectives of the invention, a Dual Ended Laser Swing Aid has been devised. The Swing Aid has the general shape of a golf club, consisting of a grip, shaft and head. The Swing Aid accommodates two back-to-back axial laser modules, pointing in linearly opposite directions.

The upper, or grip, laser module, located close to the top of the grip, emits a laser beam directed upward into the air through a hole in the grip knob which forms the upper end of the grip on the shaft. The lower, or head, laser module, located in the shaft below the upper laser module, emits a laser beam directed downward into the air through a hole in the bottom of the head. The two laser beams are equal and opposite, and lie on and thus are coincident with the same geometrical straight line which is the central axis of the shaft.

For good visibility, lasers emitting red-colored beams of low intensity which will not injure the golfer or damage the golfer's clothes are used. Such a laser typically requires a 3-volt power supply with a 60 milliampere operating current, and produces a beam of 650 nanometer wavelength and 2.5 milliwatt output power, with a range of 500 meters and a mean time to failure of 10,000 hours.

Both laser modules are powered by the same DC circuit which includes a battery and a "momentary" on-switch mounted on the shaft and through the grip for convenient safe manual laser actuation. Typically the battery is located in the hollow shaft between the laser modules. For slender shafts two axial 1.5 volt batteries in series have been found suitable.

The head may have different geometrical shapes, such as a cube or sphere, and is not meant for hitting an actual golf ball. This is to prevent any impacts from destroying the axial alignment of the laser beams.

The sequence of a correct golf swing and the associated laser beam patterns are as follows: At address the head laser will shine on the ground where the ball would be. During a correct back swing the head laser will show the desirable path of the beginning take away line. The grip laser next indicates the target or takeaway line and the head laser shows the swing plane line.

On the downswing the grip laser shows the correct target line and the head laser shows the beginning of the swing plane line of the down swing. At the finishing of the down swing, prior to the follow through, before impact with the imaginary ball, the head laser will then show the proper swing plane line through the target line to impact. At impact the grip laser will point to the center of the golfer's body.

Since the golfer is always looking at the ball until after impact, the golfer alone can observe all the laser tracks, with or without the help of a video camera. If the laser lines do not conform to the correct motions described above, the golfer has a set of diagnostics on how to correct the various parts of the golf swing.

The overall advantage of the Dual Ended Laser Swing Aid is seen to be the indication of the motion of both the grip and the head of a golf club during a complete swing sequence. This knowledge permits the golfer to correct and improve the complete golf swing. Other advantages realize the stated objectives, including suitability for golfers of all sizes and both genders, portability, ruggedness, simplicity, low cost, and use indoors or outdoors.

BRIEF DESCRIPTION OF THE DRAWING

A better understanding of the invention may be gained by reference to the following Detailed Description in conjunction with the accompanying drawing in which.

DETAILED DESCRIPTION OF THE PREFERRED EMBODIMENTS

Figure 1:
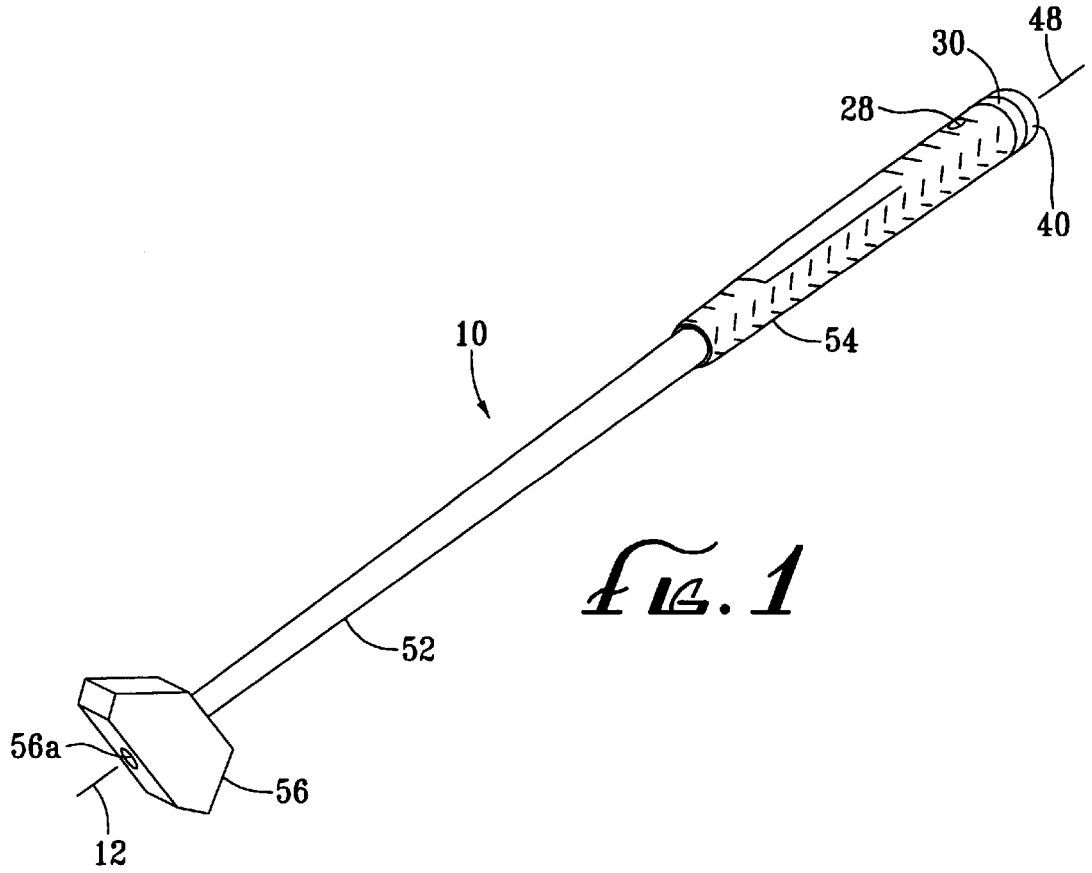
FIG. 1 is an external pictorial view of the Swing Aid.

Referring to FIG. 1, there is shown an external pictorial view of the Dual Ended Laser Swing Aid 10 of this invention, consisting of head 56, shaft 52, and grip 54. Head 56 is a solid metallic mass of symmetrical shape, such as a cube, sphere or trapezoidal solid, with a cylindrical axial hole 56*a* to permit the emergence into the atmosphere of head laser beam 12. Attached to head 56 is hollow shaft 52 of narrowing cross-section in the direction toward head 56. Head laser beam 12 is produced by components inside the upper end of shaft 52, and passes through shaft 52 before reaching head 56.

Figure 2:
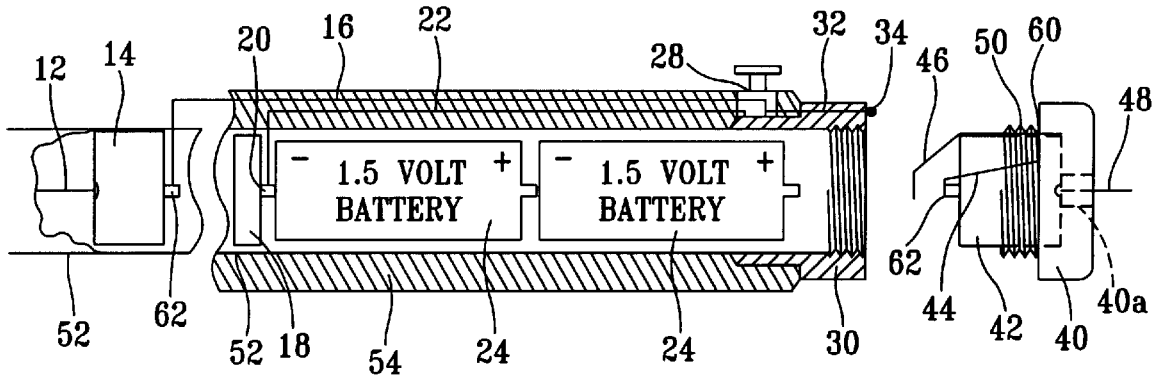
FIG. 2 is an exploded sectional view of the shaft and grip of the Swing Aid showing the disposition of the two laser modules and the associated DC circuitry.

Grip 54 surrounds the upper end of shaft 52 which contains the internal components, shown in detail in FIG. 2, which produce head laser beam 12. Protruding from the external surface of grip 54 is the momentary switch 28, convenient to the golfer's hands which grip Swing Aid 10. When depressed by hand, switch 28 closes the DC circuit inside shaft 52 to activate laser beams 12 and 48. For safety reasons switch 28 is spring-loaded and must be kept depressed for laser beams 12 and 48 to operate. When not depressed, i.e., when the golfer takes his hands off Swing Aid 10, switch 28 opens the DC circuit and stops laser beams 12 and 48.

A shaft fitting 30 is attached to the free upper end of shaft 52. A grip knob 40, which houses the components producing grip laser beam 48, is removably attached to fitting 30 to close off shaft 52. Grip knob 40 is removed from shaft 52 for installation of DC power inside the upper end of shaft 52. When knob 40 is re-attached to shaft 52, Swing Aid 10 is completely assembled, mechanically and electrically, for activation of laser beams 12 and 48 by momentary switch 28.

Referring to FIG. 2, an exploded sectional view of the upper end of shaft 52 and grip 54, there are shown the components producing laser beams 12 and 48. Basically, head laser module 14 produces laser beam 12, and grip laser module 42 produces laser beam 48. Laser modules 14 and 42 are identical and connected through negative hot laser terminals 62 to a 3 volt DC circuit energized by two 1.5 volt batteries 24 in series.

Also, the case of module 14 is a positive ground and through its mechanical, and so electrical, contact with the inner wall of shaft 52 makes shaft 52 a positive ground. Batteries 24 are spatially located between laser modules 14 and 42. The DC circuit is wired through momentary switch 28.

Figure 3:
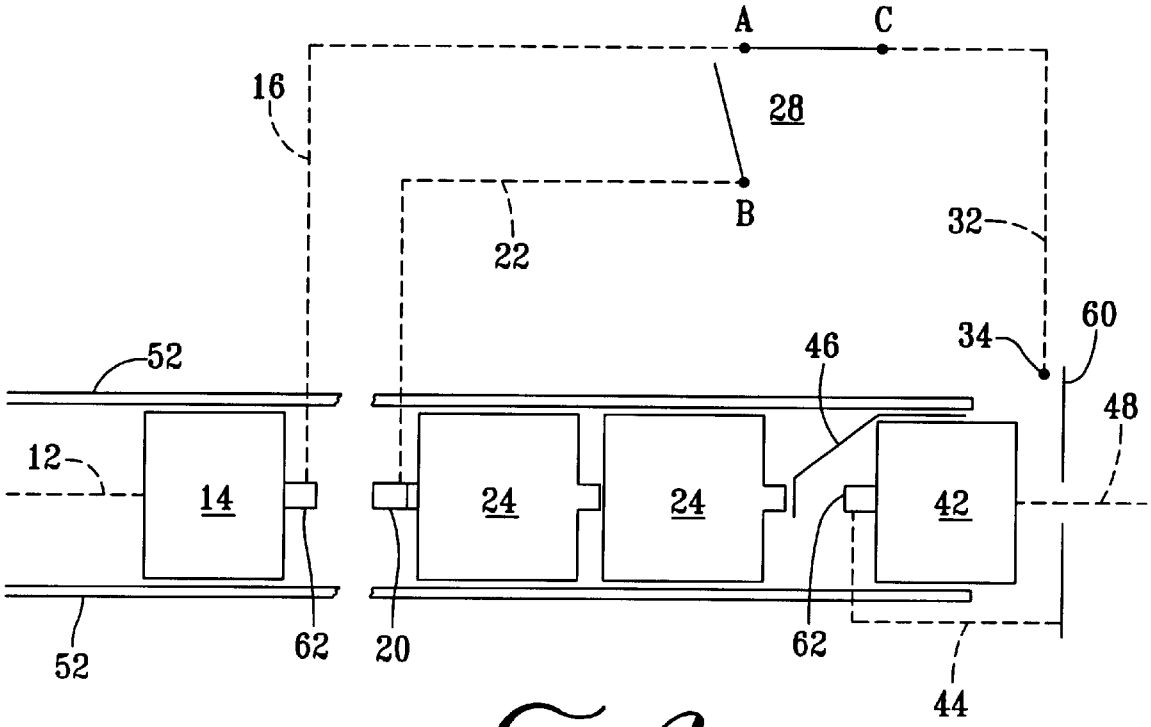
FIG. 3 is a circuit diagram showing the electrical connections of the assembled Swing Aid.

Referring to the circuit diagram of FIG. 3, the DC circuit consists of the following electrical connections: head laser module hot wire 16 connecting module 14 to head laser bridging terminal A of switch 28; battery hot wire 22 connecting hot battery terminal 20 on the negative pole of lower battery 24 to D.C. power source terminal B of switch 28; switch wire 32 connecting grip laser bridging terminal C of switch 28 to hot pin 34 which contacts grip knob ring connector 60 when assembled; ground circuit completion spring 46, when assembled, making multiple contacts with shaft 52, the positive ground pole of upper battery 24, and the negative ground case of laser module 42, to complete the positive ground of the DC circuit; and grip laser hot wire 44 connecting laser terminal 62 on module 42 to ring connector 60. Momentary switch 28 closes and opens the DC circuit at terminals A and B, as shown in FIG. 3.

Referring again to FIG. 2 for mechanical structure, an insulator 18 is interposed between module 14 and the negative terminal of lower battery 24. The upper extremity of hollow shaft 52 is a female thread fitting 30 into which are firmly screwed male threads 50 on grip knob 40 to complete the assembly of Swing Aid 10. Grip knob 40 is recessed to accommodate module 42, and has a central axial cylindrical hole 40*a* through which laser beam 48 emanates from module 42 into the atmosphere. Ring 60 is attached to the lower side of grip knob 40 so as to contact pin 34 when assembled, which completes the negative hot DC circuit.

FIGS. 4, 5, 6, 7, and 8 illustrate the practical use of the Swing Aid by a golfer during a complete golf swing. In these figures the small white circles denote the trace of head laser beam 12, and the small black circles denote the trace of grip laser beam 48.

Figure 4:
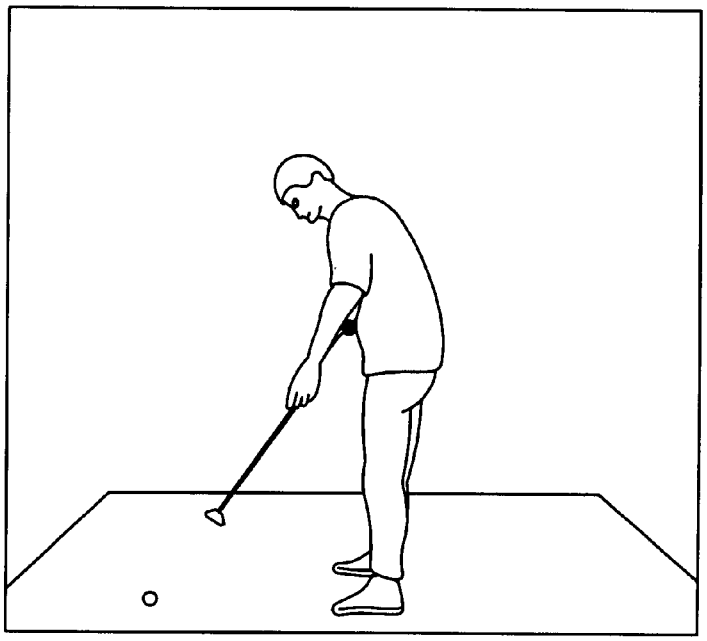
FIG. 4 is a pictorial view of a golfer holding the Swing Aid in the correct address position with the traces of the head laser and grip laser.

Referring to FIG. 4, a pictorial view of a golfer holding Swing Aid 10 in the correct address position, there are shown the trace of the head laser beam on the ground, and the trace of the grip laser beam on the golfer's body. If the grip laser trace does not appear on the golfer's body, instead aiming to the right or left of the golfer, the address position is incorrect and must be remedied.

Figure 5:
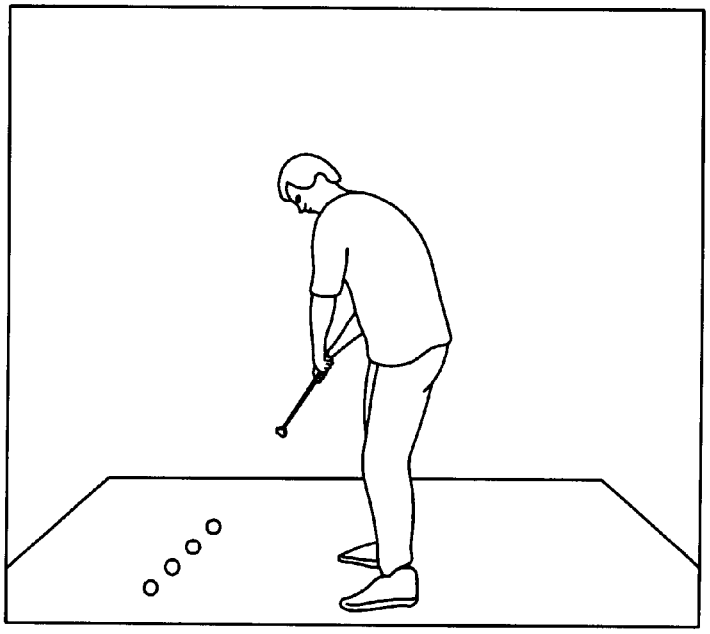
FIG. 5 is a pictorial view of a golfer holding the Swing Aid in the correct take away position with the trace of the head laser.

Referring to FIG. 5, a pictorial view is shown of a golfer holding Swing Aid 10 in the correct take away position. The head laser trace indicates a straight take away line during the initial motion of a correct back swing.

Figure 6:
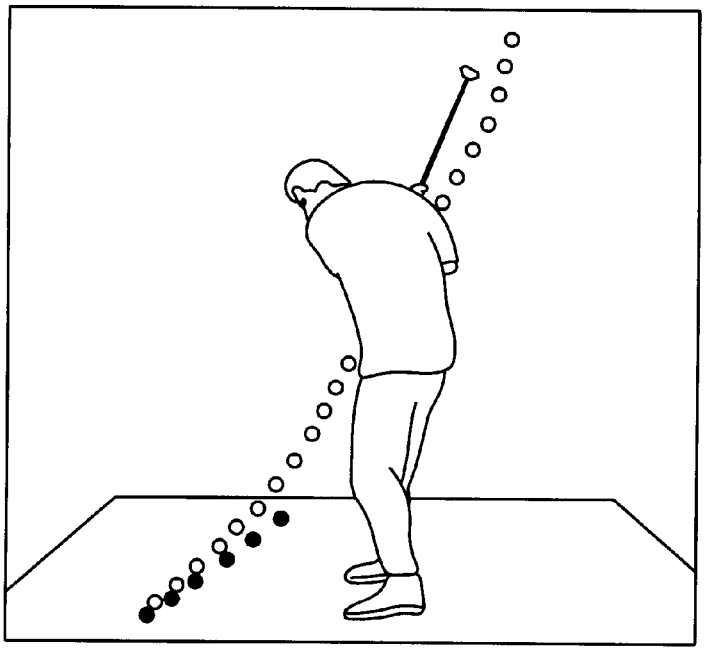
FIG. 6 is a pictorial view of a golfer holding the Swing Aid during a correct back swing with the traces of the grip laser and head laser.

Referring to FIG. 6, a pictorial view is shown of a golfer holding Swing Aid 10 during a correct back swing. Here the grip laser trace coincides with the head laser trace of FIG. 5. The head laser trace points out the proper back swing plane.

Figure 7:
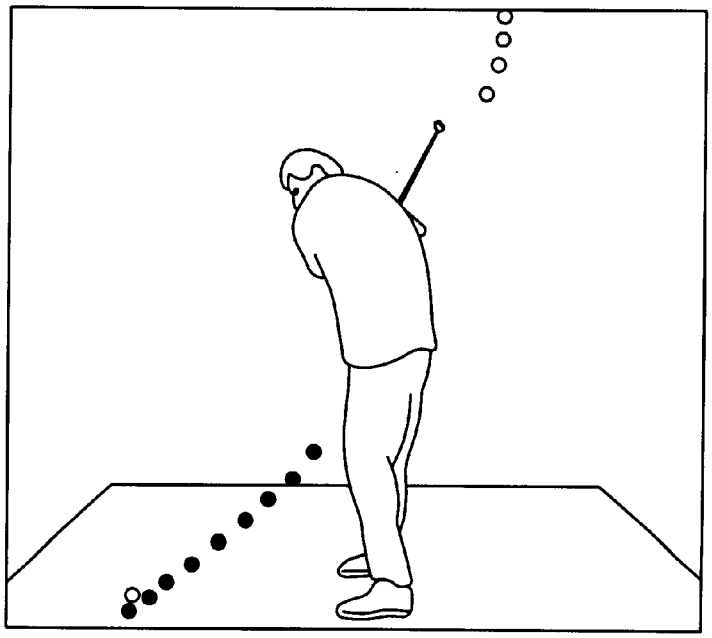
FIG. 7 is a pictorial view of a golfer holding the Swing Aid during a correct downswing with the trace of the head laser, with the trace of the grip laser on the target line.

Referring to FIG. 7, a pictorial view is shown of a golfer holding Swing Aid 10 during a correct down swing. Here the grip laser trace coincides with the original back swing line. The head laser trace coincides with the back swing plane of FIG. 6.

Figure 8:
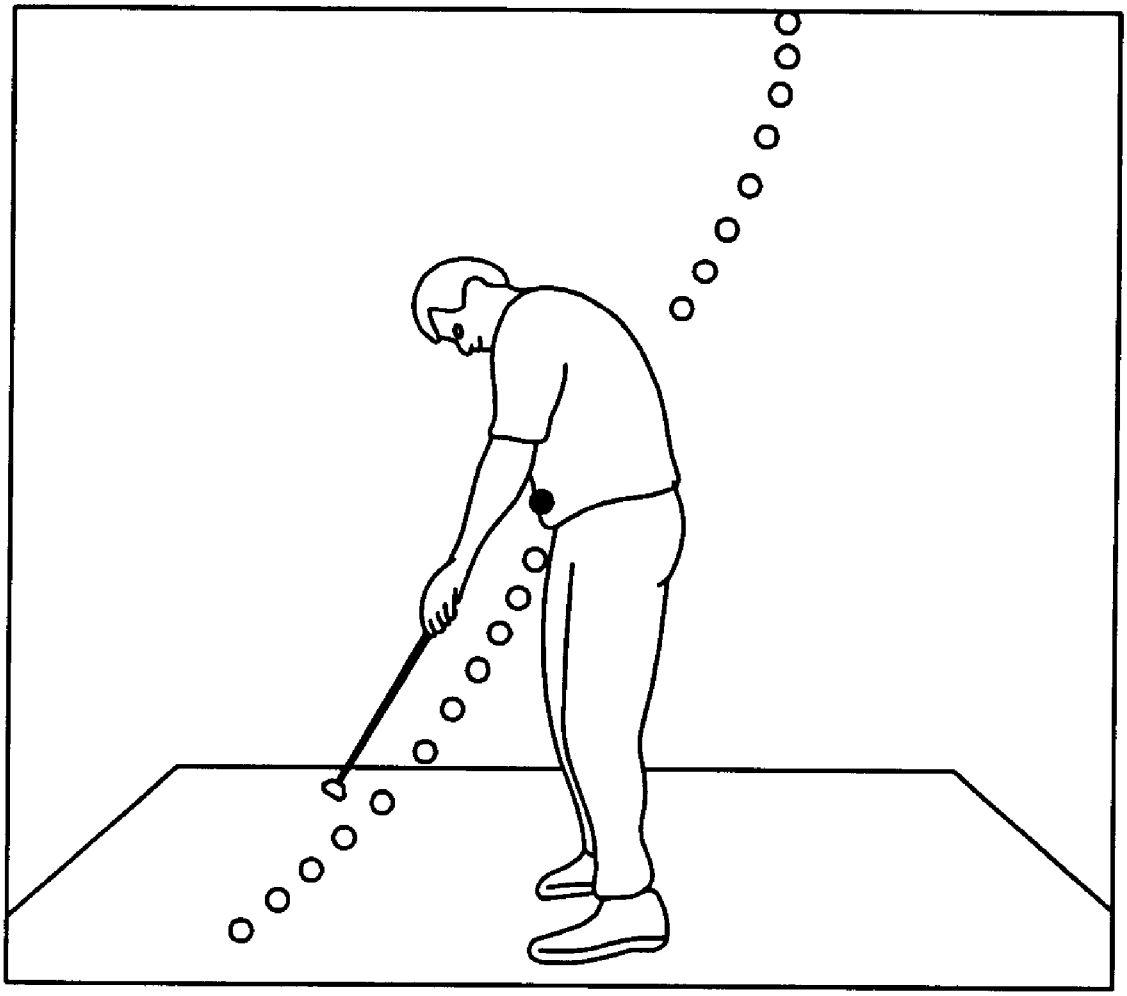
FIG. 8 is a pictorial view of a golfer holding the Swing Aid at correct impact with the traces of the grip laser and head laser.

Referring to FIG. 8, a pictorial view is shown of a golfer holding Swing Aid 10 at correct impact with the imaginary ball, as indicated by the head laser trace. The grip laser trace points at the center of the golfer's body.

It is seen that the golfer can use Swing Aid 10 at each component stroke of a swing, and so concentrate only on the strokes which deviate from the correct motion. Repeated swings with Swing aid 10 serve to remedy any bad habits, and the golfer can do so alone whenever and wherever it is convenient.

This invention solves the problem of providing dual laser beams 12 and 48, and at the same time making installation and exchange of batteries 24 an easy and straightforward task by the provision of detachable and replaceable grip knob 40 and of ground circuit completion spring 46. As shown in FIG. 2 and FIG. 3, these and other mechanical construction features achieve the required complete DC circuit including momentary switch 28. Other advantages of an economic and operational nature have been stated under the headings of "Objects of the Invention" and "Summary of the Invention". Other embodiments of the invention are possible without departing from the spirit of the invention and are considered to lie within its confines, as delineated by the appended claims.

What is claimed is:

1. A dual ended laser swing aid in the general shape of a golf club for assisting a golfer to correctly swing a golf club, said dual ended laser swing aid comprising:

a hollow longitudinal shaft symmetrical about a central axis;

a head with an axial hole and attached to a lower end of said shaft;

a grip surrounding and attached to an upper portion of said shaft;

a grip knob with an axial hole and detachably attached to an upper end of said shaft;

a storage battery powered electrical DC circuit located inside said upper portion of said shaft;

a head laser module located inside said shaft, energized by said DC circuit and producing a linear head laser beam directed axially downward through said shaft coincident with said central axis thereof and through said axial hole in said head into the atmosphere;

a grip laser module located inside said shaft and energized by said DC circuit and producing a linear grip laser beam directed axially upward through said shaft coincident with said central axis thereof and through said axial hole in said grip knob into the atmosphere, said grip laser module being equal and opposite to said head laser module so that said head laser beam and said grip laser beam are of the same intensity and aimed in exactly opposite directions along the central axis of said shaft;

whereby the head laser beam produces a trace indicative of the motion of said head, and the grip laser beam produces a trace indicative of the motion of said grip, with the golfer being able to observe said head laser trace and said grip laser trace during a golf swing and, from a knowledge of said laser traces corresponding to a correct golf swing, make the necessary changes in the golf swing to achieve a correct golf swing.

2. A golf swing training device for a golfer comprising:

a hollow shaft defining a central longitudinal axis and having first and second ends with a hand grip on the first end and a head on the second end;

a pair of lasers mounted in the device in spaced relationship and pointed in opposite directions along said axis of said shaft for generating first and second laser beams, said first beam emanating from said hand grip and said second beam emanating from said head and being coincident with said first beam and said central axis of said shaft;

a grip knob removably mounted in said first end of said shaft, and one of said pair of lasers mounted in said grip knob;

an electrical power source and circuit mounted in the device for selectively operating said pair of lasers for the golfer to practice golf swings by observing the paths of said lasers during the golf swing; and a switch for selectively actuating said pair of lasers.

3. The device of claim 2, said electrical power source and circuit include at least one dry cell battery mounted inside said hollow shaft internally of said hand grip for operating said pair of lasers.

4. The device of claim 2, wherein said head, shaft and grip are of a total length substantially less than the distance to the ground when the golfer grips the hand grip in a stance for taking the practice golf swings.

5. The device of claim 2, wherein said switch is disposed within said hand grip and spring biased so as to actuate said lasers to an on position upon the golfer gripping the hand grip for performing the practice swing and deactivate said lasers to an off position upon the golfer releasing the hand grip.

6. A golf swing training device for a golfer comprising:

a hollow shaft defining a central longitudinal axis and having first and second ends with a hand grip on the first end and a head on the second end;

a pair of lasers mounted in the device in spaced relationship and pointed in opposite directions along said axis of said shaft for generating first and second laser beams, said first beam emanating from said hand grip and said second beam emanating from said head and being coincident with said first beam and said central axis of said shaft;

an electrical power source and circuit mounted in the device for selectively operating said pair of lasers for the golfer to practice golf swings by observing the paths of said lasers during the golf swing; and a switch for selectively actuating said pair of lasers.

7. The device of claim 6 wherein said switch is disposed within said hand grip and is spring biased so as to actuate said lasers to an off position upon the golfer gripping the hand grip for performing the practice swing and deactivate said lasers to an off position upon the golfer releasing said hand grip.

* * * * *